US005182020A

United States Patent [19]

Grimwood

[11] Patent Number: 5,182,020

[45] Date of Patent: Jan. 26, 1993

[54] CENTRIFUGE SEPARATING SYSTEMS

[75] Inventor: Geoffrey L. Grimwood, Holmfirth, England

[73] Assignee: Thomas Broadbent & Sons Limited, Huddersfield, England

[21] Appl. No.: 715,506

[22] Filed: Jun. 14, 1991

[30] Foreign Application Priority Data

Jun. 18, 1990 [GB] United Kingdom ..... 9013371

[51] Int. Cl.[5] ..... B04B 1/20

[52] U.S. Cl. ..... 210/512.1; 210/781; 494/52; 494/53

[58] Field of Search ..... 494/50, 52, 53, 58, 494/59; 210/512.1, 781

[56] References Cited

U.S. PATENT DOCUMENTS

| | | | |
|---|---|---|---|
| 2,743,864 | 5/1956 | Lyons | 494/54 |
| 4,209,128 | 6/1980 | Lyons | 494/37 |
| 4,509,942 | 4/1985 | Gunnewig | 494/53 |

FOREIGN PATENT DOCUMENTS 2057555 6/1972 Fed. Rep. of Germany .

OTHER PUBLICATIONS

European Patent Office Search Report re Patent Appln. No. 91 305 510.2.

Soviet Inventions Illustrated, Dated Oct. 1966, Section I Chemical Regarding SU-A-179245 (Nikolenko), of Feb. 3, 1966.

Japanese Abstract, vol. 14, No. 17 (C-675) (3960), Jan. 16, 1990, regarding the Separation Plate System Decanter of Japanese Appln. No. 63-85373.

*Primary Examiner*—Robert A. Dawson
*Assistant Examiner*—David Reifsnyder
*Attorney, Agent, or Firm*—Tilton, Fallon, Lungmus & Chestnut

[57] ABSTRACT

A centrifuge, for example a decanter type centrifuge, comprises a bowl (10) rotatable about a longitudinal rotational axis (Y), an inlet (14) for feeding into the bowl a slurry to be separated, and a helical scroll conveyor (12) rotatably mounted about the rotational axis and adapted to be rotated within the bowl at a different speed from that of the bowl in order to scroll particles adjacent to the bowl wall to a solids discharge end of the bowl. The decanter further comprises a plurality of walls (23) at least partly submerged in the centrate and defining passages therebetween. By providing a plurality of passages, through which the centrate to be clarified can travel, particles (e.g. solids) to be separated from the centrate have a short distance to travel under centrifugal force before entering the boundary layer at the walls of the passages. This enables more of the fine particles in the centrate to be separated out.

15 Claims, 5 Drawing Sheets

CENTRIFUGE SEPARATING SYSTEMS

DESCRIPTION

The present invention relates to systems for separating solid particles from a slurry and for separating two liquids of differing specific gravities plus solids, and in particular, but not exclusively, to such separating systems which utilise a decanting type centrifuge of the solid bowl or screen bowl type (hereinafter called "decanters").

Systems for separating solid particles from liquid and separating two liquids of differing specific gravities plus solid particles which utilize decanters have been restricted in the minimum size of solid particle and liquid droplet that can be separated. Whilst this minimum size varies with the difference in specific gravities of the liquids and the solid, the dimensions and speed of the decanter and the volumetric throughput, in industrial practice this minimum size falls in the range 2 to 20 microns equivalent diameter.

For clarity in the description that follows reference is made only to solids-liquid separation but the description applies equally to liquid-liquid separation, with comment on solids referring, where applicable, to liquid droplets when considering separation in the clarification zone.

Referring firstly to FIG. 7, the conventional screen bowl decanter illustrated therein comprises a bowl 10 having a cylindrical portion 10*a*, a tapering conical portion 10*b* and a narrower, perforated, drying portion 10*c*. The bowl is rotatably mounted about its longitudinal axis X, and a helical screw conveyor 12 is mounted coaxially with the bowl, the tips of the blades of the screw conveyor 12, in use, lying adjacent to the inner wall of the bowl 10. A feed pipe 14 is provided to feed a solids/liquid slurry into the bowl to be separated. In use, the bowl is rotated rapidly, and the solids/liquid slurry forms a layer of thickness d adjacent to the wall of the bowl. The depth of liquid is limited by discharge apertures 16 in an end face of the bowl 10. The solids are separated from the liquids in the slurry, and are forced by centrifugal force onto the bowl wall. The helical screw conveyor is arranged to rotate at a slightly different speed from the bowl, so that solids at the bowl inner wall are scrolled from the portion 10*a* of the bowl down towards the discharge portion 10*c*, and thence to the solids discharge outlet 17.

The conventional screen bowl decanter is essentially divided into four zones, namely a feed zone A, an initial drying (conical) zone B, a final drying (screen) zone C and a clarification (cylindrical) zone D. A conventional *solid* bowl decanter is essentially divided into three zones A, B and D, has no final drying zone C, and discharges the separated solids through discharge outlets at the small diameter end of the conical zone B.

A solids/liquid slurry flowing in the feed pipe is accelerated in the feed zone A where the bulk of the large solids settle rapidly on the bowl wall and are scrolled by the differentially rotating conveyor 12 to the initial and final drying zones B (and, if present, C) prior to discharge at a discharge end 17. Fine solids that remain suspended in the liquid in the feed zone flow through the clarification zone D along the spiral path between the conveyor blades towards the apertures 16. In this spiral path the fine solids move towards the centrate outlet 16 at the velocity of the liquid flow and outwards at a radial velocity that is a function of the centrifugal force generated by the rotation of the decanter, the liquid viscosity, the size of the solid particle and extraneous effects of any adjacent particles. Where the flow velocity is such that the solid is carried by the liquid to the outlet 16 before the radial velocity has placed the solid against the bowl 10, that solid will not have been separated, but instead will have been discharged through the aperture 16 as part of the liquid. Under a given set of conditions it is the solids below a certain size, known as the cut point, that are lost in this way and represent an inefficiency of the separation.

FIG. 8 shows the spiral liquid path in the clarification zone of a decanter, "unwound" to appear as a long tank of length L (the length of the spiral path between the conveyor blades 12), width W (the pitch of the screw conveyor 12 and liquid depth d, the contents are which are subjected to a centrifugal force F generated by rotation of the bowl 10. Trajectory P shows the path of a typical solid suspended in the mixture to be separated which is deposited against the bowl wall and thus recovered, and trajectory Q shows the typical path of a smaller solid suspended in the mixture to be separated that is not deposited on the bowl wall but instead is lost and flows with the liquid through the centrate discharge aperture 16. Thus, in a conventional decanter, in order for solids to settle on the bowl wall, the average solid must travel radially outwardly half the radial depth d of the slurry before it travels the spiral distance L of the clarification zone, whereafter it is scrolled by the screw conveyor 12 and discharged with the solids.

It is an object of the present invention to improve the separation by removing more fine solids in the clarification zone, and thus to improve the separating efficiency.

In accordance with the present invention, there is provided a centrifuge comprising a bowl rotatable about a longitudinal rotational axis, an inlet for feeding into the bowl a mixture to the separated, discharge means adapted to discharge from the bowl particles which have been separated from the mixture and displaced to a location adjacent to the bowl wall by the action of the centrifuge, and a plurality of wall means which, in use, extend into the mixture to be separated and which define a plurality of passages therebetween through which particles in the mixture to be separated can travel.

By providing a plurality of passages, through which the mixture to be clarified can travel, particles (e.g. solids) to be separated from the mixture have a short distance to travel under centrifugal force before entering the boundary layer at the walls of the passages. Once they are in the boundary layer, the flow of the liquid has no further effect on them, and they are thus effectively separated from the liquid. The centrifugal force will then displace the solids in the boundary layer directly to the bowl wall, where they are scrolled to the discharge end. Thus, many more of the finer particles in the mixture are separated rather than carried out of the decanter with the liquid Preferably, the passages are located in a generally cylindrical, clarification zone of the decanter.

Preferably, the helical scroll conveyor is in ribbon form mounted on supports, e.g. blades, fixed to a hub along the longitudinal axis, and the passages extend from the vicinity of the hub towards the decanter bowl wall.

In a preferred embodiment, the passages are formed by a plurality of spaced-apart plates. The plates may be rotatable with the helical scroll conveyor and may be secured, or releasably securable, to the conveyor. The plates may be mounted on a support which is mountable on a hub of the conveyor. There may be a plurality of groups of plates, each mounted on a respective support which is releasably securable to the conveyor hub.

The helical scroll conveyor, or a portion of it, may be in the form of a helical ribbon conveyor, for example in a clarification zone of the decanter. The ribbon conveyor may be supported on a plurality of ribbon conveyor supports attached to the conveyor hub. A group of plates may be securable in the gap between adjacent ribbon conveyor supports, which may themselves also be in the form of plate members.

The planes of the plates forming the passages and/or of the ribbon conveyor support plates may be aligned parallel to the longitudinal rotational axis of the decanter and may be inclined to the radial direction of the conveyor.

The plates forming the passages may be of substantially the same length, or may be of differing lengths. The latter case provides passages of different widths, allowing larger particles to settle in the wider passages, thus reducing the likelihood that they will block the narrower passages, where the smaller particles are more likely to settle.

Preferably, the decanter is provided with one or more apertures in an end wall of the bowl to limit the depth of centrate in the bowl. The or each aperture may be provided in a covering, which may be removed in order to gain access to the bowl interior.

By way of example only, specific embodiments of the present invention will now be described, with reference to the accompanying drawings, in which:

FIG. 1 is a longitudinal cross section through a first embodiment of decanter in accordance with the present invention;

FIG. 2*a* is a cross section looking in the direction of arrows II of FIG. 1;

FIG 2*b* is an enlarged view of a portion of FIG. 2*a;*

FIG. 3*a* is a perspective view of a set of passage forming plates forming part of the decanter of FIG. 1;

FIG. 3*b* is a diagram of the liquid velocity between adjacent plates of FIG. 3;

FIG. 4*a,b,c* is a side view of different blades which can be used as an alternative to the blades of FIG. 3;

FIG. 5*a,b* is a diagrammatic representation of positioning of the blades of FIG, 53;

Figure 1:
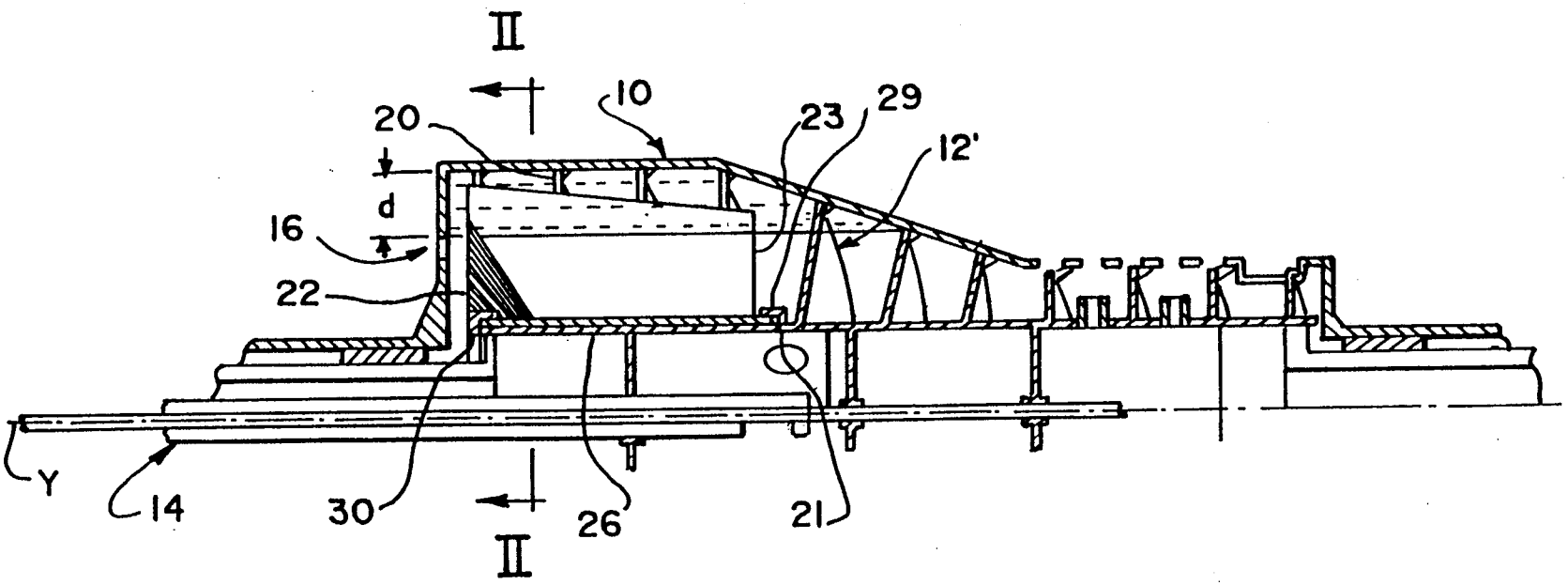

Referring firstly to FIG. 1, the decanter of the present invention comprises a bowl 10 adapted to rotate about a central longitudinal axis Y, and which is fed with slurry via an inlet pipe 14. Rotation of the bowl 10 about the axis Y causes the slurry to move radially outwardly into contact with the internal wall of the bowl, the depth d of the slurry being limited by an outlet 16, as in the prior art construction. A helical scroll conveyor 12' is rotatably mounted coaxially with the bowl, and with a small running clearance with its interior surface. The helical screw conveyor 12' is arranged to be rotated at a slightly different rate from that of the bowl, thus enabling solids which have accumulated on the bowl wall to be scrolled towards the solids discharge end of the bowl.

Figure 2A:
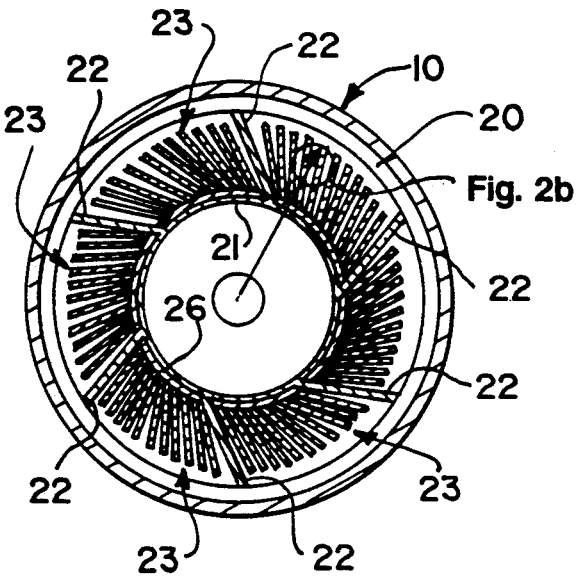
Figure 2B:
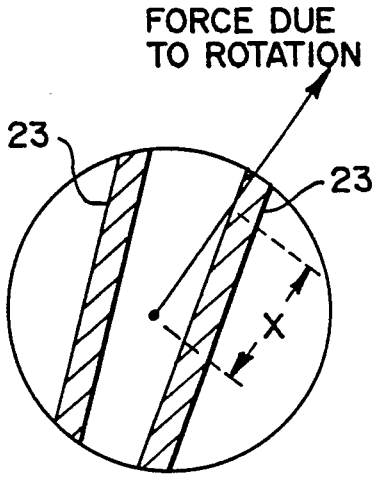
Figure 3B:
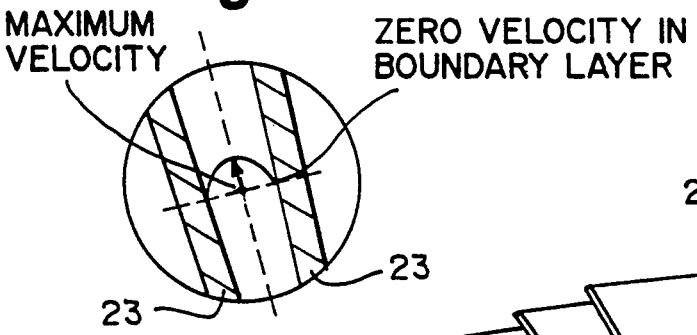

The helical screw conveyor is conventional in the region of the initial drying and feed zones, i.e. in zones A, B and C. However, in the clarification zone, the full depth conveyor is reduced to a thin ribbon conveyor 20 which is fixed to the conveyor hub by a number of equally-spaced plates 22 attached to the conveyor hub 21, and whose planes are arranged parallel to the rotational axis Y, but which do not pass through the axis Y, as best seen in FIG. 2. It will be noted that the angled plates 22 are partly under the liquid surface so that the mixture to be separated flows at a much lower velocity in an axial direction towards the discharge apertures 16, and so that virtually no spiral liquid flow is present. The space between each of the angled plates 22 are filled with movable stacks 24 of plates 23 (FIG. 3), each stack 24 comprising a plurality of thin plates 23 mounted on an arcuate base 26 having a curvature coincident with the exterior of the conveyor hub 21. The planes of the plates 23 are inclined to the radial direction, as best seen in FIG. 2, and are disposed such that their planes lie parallel to the rotational axis. The narrow gaps between the plates 23 are maintained by spacing rods 28.

Each stack 24 of plates 23 is placed in a space between two adjacent angled plates 22 which support the ribbon conveyor. One end of the arcuate plate 26 is located beneath the overhang of an angled ring 29 located on the conveyor hub, and the other end of the arcuate plate of each of the stacks 24 is retained by means of a segment of a further segmented, angled ring 30 which may be bolted to the conveyor hub. By removing the segments of the ring 30, the stacks 24, 13 may be removed and replaced as required.

Figure 3A:
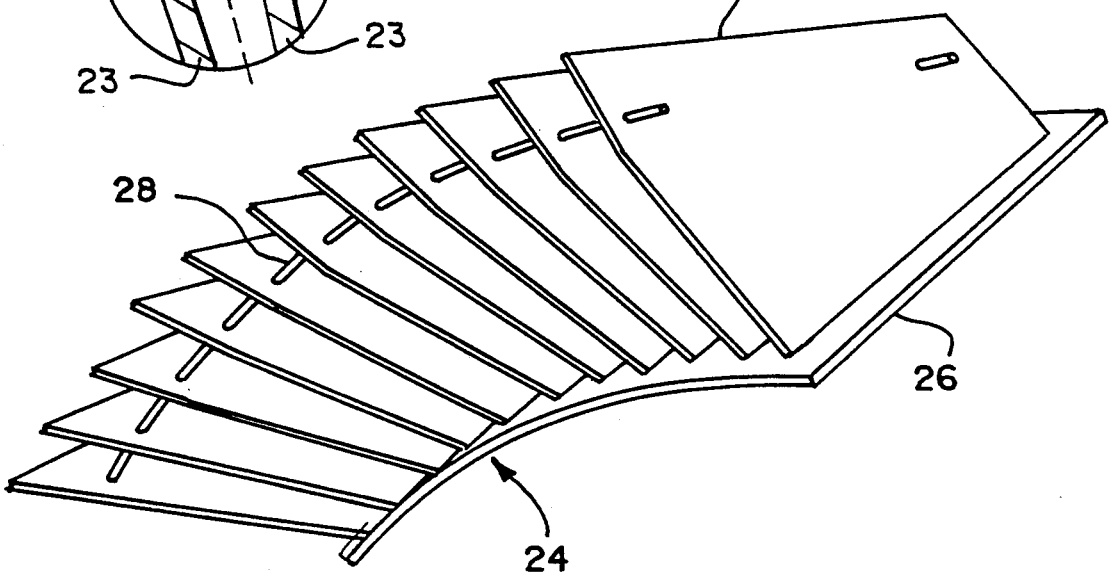

In use, the bowl 10 is rotated as in a conventional decanter, and it will be noted from FIG. 3*a* that the narrow spacing of the plates results in streamlined flow with a parabolic velocity distribution between the plates 23, the axial velocity varying between zero in the boundary layer between the plates and the liquid and a maximum at the mid-point between the two adjacent plates, the maximum velocity being substantially less than the velocity along the spiral path in the prior art construction. The radial velocity of each particle in the slurry remains unchanged, as a result of the centrifugal force generated by rotation of the bowl, but whereas in the prior art it was necessary for the average particle to travel radially outwardly by a distance equal to half the depth d of the liquid layer before it was deposited on the bowl wall, in the present invention it is merely necessary for the average solid to travel a short distance x (FIG. 2) towards one of the thin plates 23, at which point the particle is in the coundary layer and no longer subjected to liquid axial flow velocity. Once the particles have been deposited in the boundary layer adjacent to the plates, the centrifugal force displaces such particles to the bowl wall, without further displacement by the liquid flow, whereupon they are collected and scrolled by the ribbon conveyor 20 and the conventional helical screw conveyor 12' to the discharge end. By this means, fine particles (e.g. solids) which might otherwise be lost in the liquid discharge are delivered to the bowl wall, since the particles encounter the boundary layers of the plates as a result of the centrifugal force after a much shoter distance than the particles encounter the bowl wall in conventional decanters.

Figure 4A:
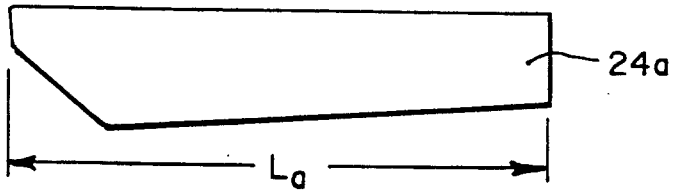
Figure 4B:
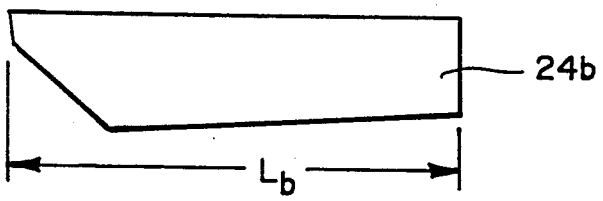
Figure 4C:
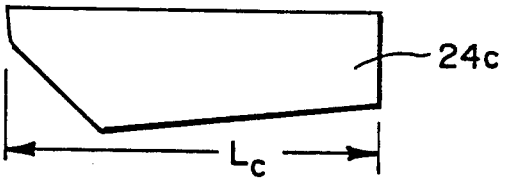
Figure 5A:
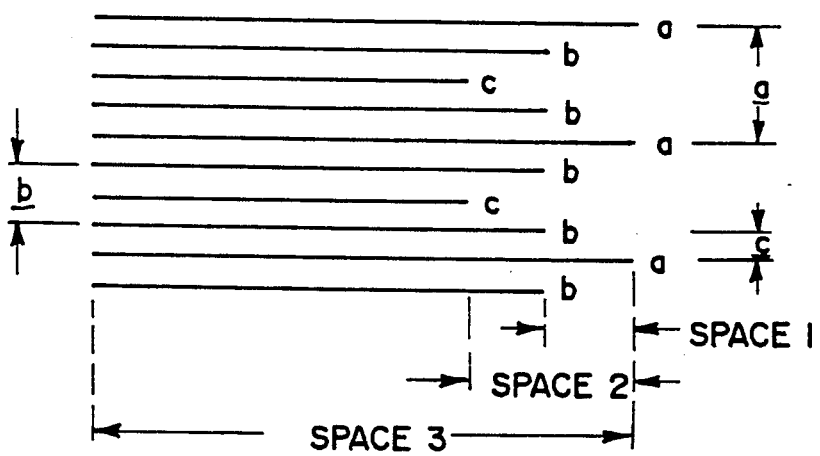
Figure 5B:
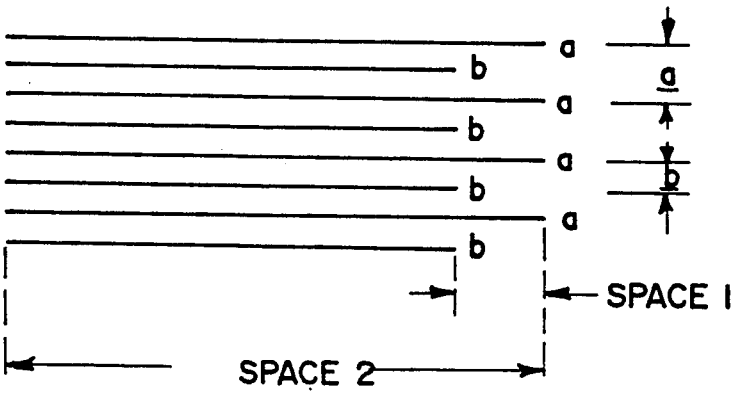

A further improvement in separation can result from the use of metal plates of varying lengths, as illustrated schematically in FIGS. 4 and 5. FIG. 4 shows side views of three plates 24*a, b* and *c* of lengths, $L_a$, $L_b$ and $L_c$, and as shown in FIG. 6*a* (which shows an arrangement of plates 24 diagrammatically), they may be arranged in the order a, b, c, b, a, etc. As shown, this produces three spaces of different width. Space 1 has the widest separation a of the plates, and provides the settling volume in which the largest of the particles in the liquid settle. Space 2 includes a narrower separation b of plates providing the settling volume for medium sized particles. The full space 3 which includes the smallest spacing c provides the settling volume for the finest particles. An alternative arrangement is shown in FIG. 5*c*, in which each stack of plates uses plates of lengths $L_a$ and $L_b$ only, providing two settling volumes only.

The advantage of using thin plates of various lengths and stacking them so that the liquid flows consecutively into a series of narrower gaps allows larger particles to be separated in the early stages of liquid flow through the clarification zone without clogging the narrower gaps that follow to separate the finest particles. It would also be possible to exchange the sets of thin plate assemblies with others of different plate spacing and length to suit the size distribution of the particles to be separated in the clarification zone.

Figure 6:
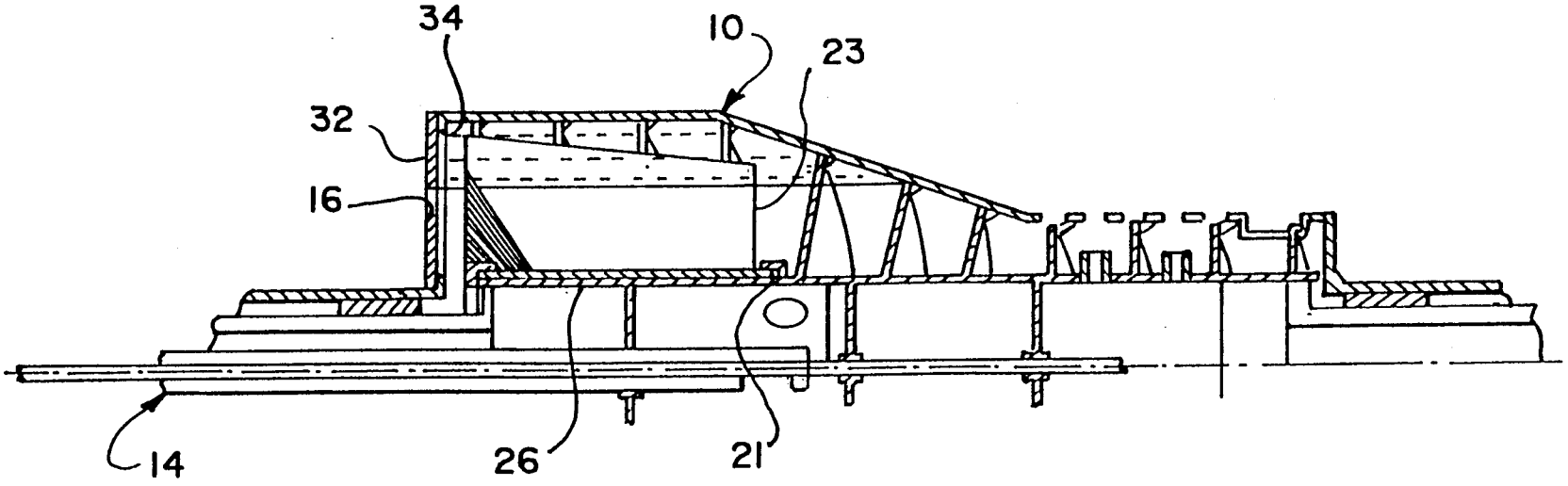
FIG 6 is a cross section through an alternative embodiment decanter in accordance with the present invention.
Figure 7:
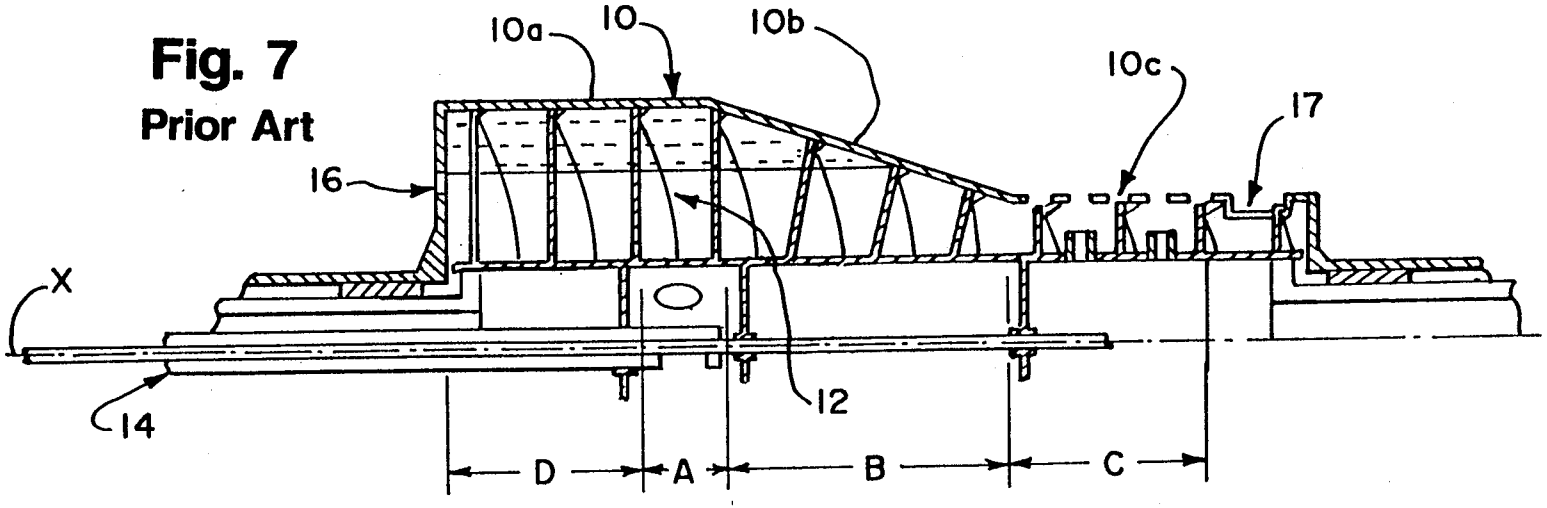
Fig. 7 Prior Art
FIG. 7 is a longitudinal cross section through a conventional decanter.
Figure 8:
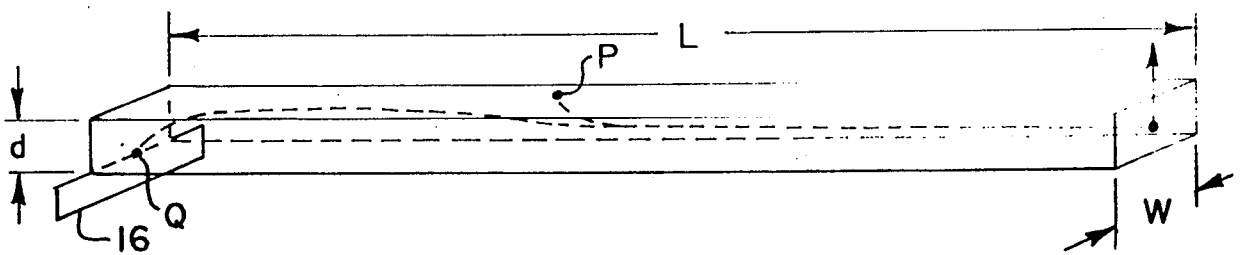
Fig. 8 Prior Art
FIG. 8 is a diagrammatic representation of the flow path of particles with the decanter of FIG. 7.

An alternative arrangement decanter which allows such an exchange is shown in FIG. 6. This is virtually identical to the embodiment of FIG. 1, with a plate 32 in the shape of segment of an annulus which convers a large segmental-shaped hole 34 in the end wall of the bowl 10. By rotating the conveyor with respect to the bowl, esch thin plate assembly can then be moved in turn opposite the segmental opening, its clamping arc removed, the thin plate assembly withdrawn through the segmental hole and a replacement fitted. To containg the liquid in the bowl, the sealed cover plate 34 is fitted over the segmental hole, and as mentioned before an outlet 16 is provided in that plate.

I claim:

1. A centrifuge comprising:

a bowl rotatable about a longitudinal rotational axis;

an inlet adapted to feed into said bowl a mixture to be separated;

a helical scroll conveyor adapted to rotate about said rotational axis of the bowl at a different speed from that said bowl, in order to scroll particles to a solids discharge end of said bowl;

a plurality of plates of different lengths which extend into said mixture to be separated; and a plurality of passages of varied length defined between said plates, through which particles in said mixture can travel.

2. A centrifuge as claimed in claim 1, wherein said plates and said passages defined therebetween extend in a direction substantially or generally parallel to said rotational axis of said bowl.

3. A centrifuge as claimed in claim 2, wherein said plates are substantially planar and the planes of said plates do not intersect the rotational axis of the bowl.

4. A centrifuge as claimed in claim 1, wherein adjacent plates are of different lengths.

5. A centrifuge as claimed in claim 1, comprising a plurality of groups of said plates.

6. A centrifuge as claimed in claim 5, wherein each group of said plates comprises a plurality of plates mounted on a base member.

7. A centrifuge as claimed in claim 6 further comprising securing means for releasably securing each group of said plates within said bowl to a rotatable hub.

8. A centrifuge as claimed in claim 7, wherein said base member is shaped to fit onto said rotatable hub, and further comprising securing means for releasably securing each group of said plates to said hub.

9. A centrifuge as claimed in claim 1, further comprising an aperture in an end of said bowl opposite to said solids discharge end and closure means for releasably closing said aperture, to permit access to the interior of said bowl.

10. A centrifuge as claimed in claim 1, wherein said helical scroll conveyor comprises a helical ribbon conveyor portion in the vicinity of said plates, said plates being located radially inwardly of said helical ribbon conveyor portion.

11. A centrifuge as claimed in claim 10, comprising a plurality of supports for said helical ribbon conveyor portion, extending outwardly from a rotatable hub.

12. A centrifuge as claimed in claim 11, wherein said plates comprise a plurality of groups of plates, each group of said plates being mounted on a base member, and wherein said groups of plates are located between adjacent supports for said helical ribbon conveyor portion.

13. A centrifuge as claimed in claim 12, wherein said helical scroll conveyor and each group of said plates are secured or securable to the same rotatable hub.

14. A centrifuge as claimed in claim 1, further comprising an aperture in an end wall of said bowl opposite to said solids discharge end, to limit the depth of said mixture to be separated.

15. A centrifuge as claimed in claim 1, wherein said bowl comprises a first cylindrical portion, a second cylindrical portion of smaller diameter than said first cylindrical portion and a conical portion joining said first and second cylindrical portions.

* * * * *

UNITED STATES PATENT AND TRADEMARK OFFICE

CERTIFICATE OF CORRECTION

PATENT NO. : 5,182,020

DATED : January 26, 1993

INVENTOR(S) : Geoffrey Luther Grimwood

It is certified that error appears in the above-identified patent and that said Letters Patent is hereby corrected as shown below:

On the title page, under Foreign Application Priority Data, "June 18, 1990" should be --June 15, 1990--.

Signed and Sealed this

Fourteenth Day of December, 1993

*Attest:*

*Attesting Officer*

BRUCE LEHMAN

*Commissioner of Patents and Trademarks*